US009457221B2

(12) United States Patent
Hsieh

(10) Patent No.: US 9,457,221 B2
(45) Date of Patent: Oct. 4, 2016

(54) HIP SWING DEVICE

(71) Applicant: Tien-Wu Hsieh, Brisbane (AU)

(72) Inventor: Tien-Wu Hsieh, Brisbane (AU)

( * ) Notice: Subject to any disclaimer, the term of this patent is extended or adjusted under 35 U.S.C. 154(b) by 237 days.

(21) Appl. No.: 14/229,927

(22) Filed: Mar. 30, 2014

(65) Prior Publication Data

US 2015/0273262 A1 Oct. 1, 2015

(51) Int. Cl.

| | |
|---|---|
| ***A63B 21/068*** | (2006.01) |
| ***A63B 23/02*** | (2006.01) |
| *A63B 22/20* | (2006.01) |

(52) U.S. Cl.

CPC ..... *A63B 21/4033* (2015.10); *A63B 21/068* (2013.01); *A63B 23/0222* (2013.01); *A63B 21/4043* (2015.10); *A63B 22/20* (2013.01)

(58) Field of Classification Search

CPC ..... A63B 23/0205; A63B 23/0211; A63B 23/0216; A63B 23/0227; A63B 2023/003; A63B 22/18; A63B 22/16

See application file for complete search history.

(56) References Cited

U.S. PATENT DOCUMENTS

2007/0298945 A1* 12/2007 Mehta ..... A63B 22/14 482/130

* cited by examiner

*Primary Examiner* — Loan H Thanh
*Assistant Examiner* — Rae Fischer
(74) *Attorney, Agent, or Firm* — Chen-Chi Lin

(57) ABSTRACT

A hip swinging device comprises a rail unit, a fixed disk and a movable disk. The rail unit includes two straight rails, two transverse rails sliding along the straight rails, and a movable element sliding along the transverse rails. The fixed disk is defined with a through hole and a plurality of movable balls. The movable disk is connected to the movable element via the through hole and is abutted against the balls. The movable disk can slide back and forth with the to and fro sliding of the transverse rails along the straight rails, the movable disk can slide from left to right with the to and fro sliding of the movable element along the transverse rails, and the movable disk also can rotate. The movable disk allows the user to achieve better waist and hip twisting effect while sitting.

11 Claims, 8 Drawing Sheets

HIP SWING DEVICE

BACKGROUND OF THE INVENTION

1. Field of the Invention

The present invention relates to a hip swinging device, and more particularly to a hip swinging device that can allow one to achieve better waist and hip movement as it can slide back and from left to right as well as rotate. The device also allows the user to engage the swinging function of the device at any time the user desires.

2. Description of the Prior Art

With the development of science and technology, networking is widely used in various aspects, such as information and media, education, shopping, entertainment and so on. The computer is a tool that allows one to easily access networking by just sitting down on the chair. However this leads to people having to be in the sitting position and remain stationary for a prolonged amount of time while using the computer, which results in limited movement of the waist and hip. Lack of waist and hip movement can cause strain and tension on the body as well as lack of physical activity. In order to maintain good health, more and more people began to have increasing awareness to physical exercises. However to have exercises targeting the waist and hip region of the body cannot be achieved without a hip swinging device.

The present invention has arisen to mitigate and/or obviate the afore-described disadvantages.

SUMMARY OF THE INVENTION

The primary objective of the present invention is to provide a hip swinging device. To achieve the above objective, a hip swinging device in accordance with the present invention comprises: a rail unit, a fixed disk, a fixed frame, a movable disk, a stop unit, a connecting rod and a damper.

The rail unit is provided with two straight rails, two transverse rails, two first rollers disposed at two lateral ends of the transverse rails and rotatably assembled to the straight rails, a movable element assembled between the transverse rails and two second rollers disposed at two lateral ends of the movable element and rotatably assembled to the transverse rails.

The fixed disk is defined with a oval or circular through hole penetrating the fixed disk and combining with the movable element, a plurality of movable balls assembled to a top surface of the fixed disk and a plurality of stop holes.

The movable disk is connected to the movable element via the through hole of the fixed disk and is defined with a through hole penetrating the movable disk, and a bottom surface of the movable disk is abutted against the balls.

The fixed frame is provided for connecting the fixed disk to the straight rails.

The stop unit is provided with two support rails fixed to a bottom surface of the fixed disk, two guiding pieces slidably disposed in the support rails, a plurality of elastic stop blocks fixed to top surfaces of the guiding pieces and compressed by the fixed disk. When moving the guiding pieces to make the stop blocks combined with the stop holes, the stop blocks will be protruded out of the stop holes and abutted against the bottom surface of the movable disk by its elasticity, so as to separate the movable disk from the balls.

The control rod is connected to the guiding pieces.

The movable element is defined with a through hole penetrating the movable element. The connecting rod is connected to the damper by passing through the through holes, and the damper pushes the movable element.

The movable disk and the fixed disk are arc-shaped.

The movable disk can slide back and forth with the to and fro sliding of the transverse rails along the straight rails, the movable disk can slide from left to right with the to and fro sliding of the movable element along the transverse rails, and the movable disk also can rotate. When the user sits on the movable disk, the user can twist his/her hip at any time, which can achieve better waist and hip twisting effect.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
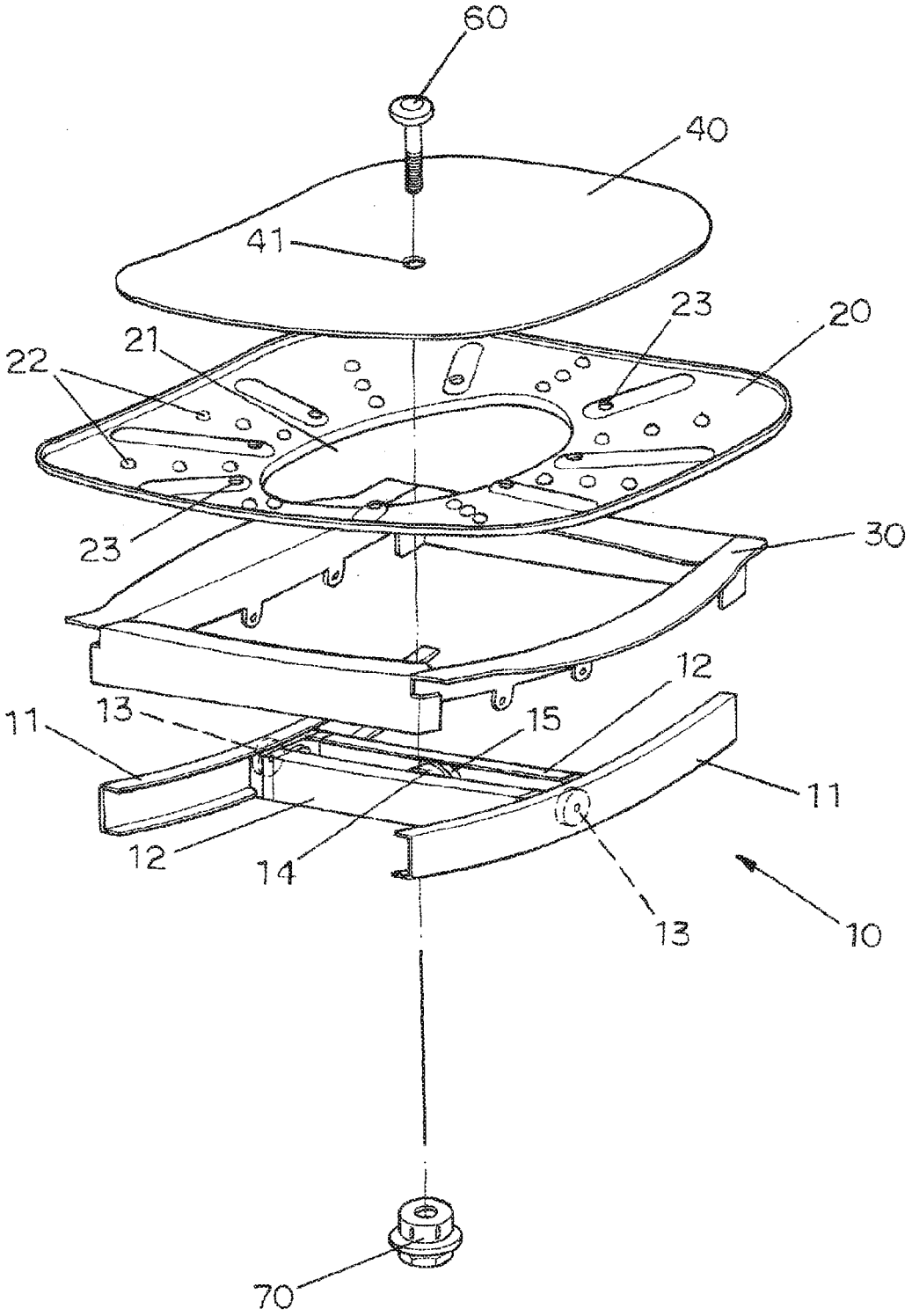
FIG. 1 is an exploded view of a hip swinging device in accordance with the present invention.
Figure 2:
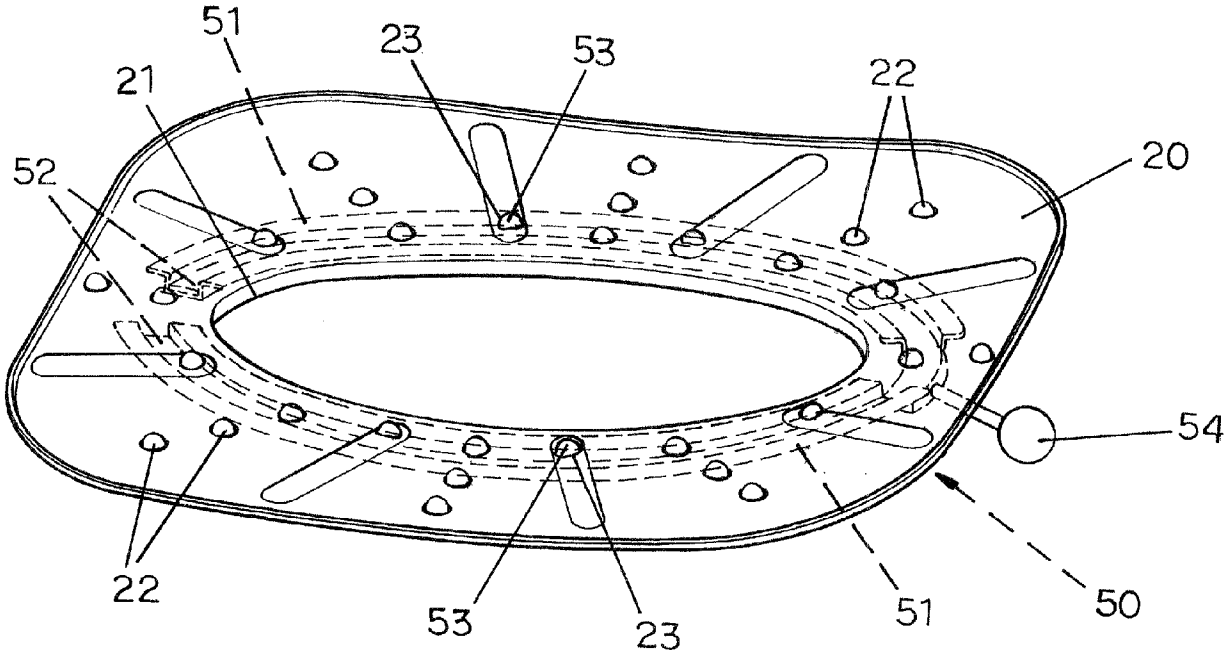
FIG. 2 is a partial assembly perspective view of the hip swinging device in accordance with the present invention.
Figure 3:
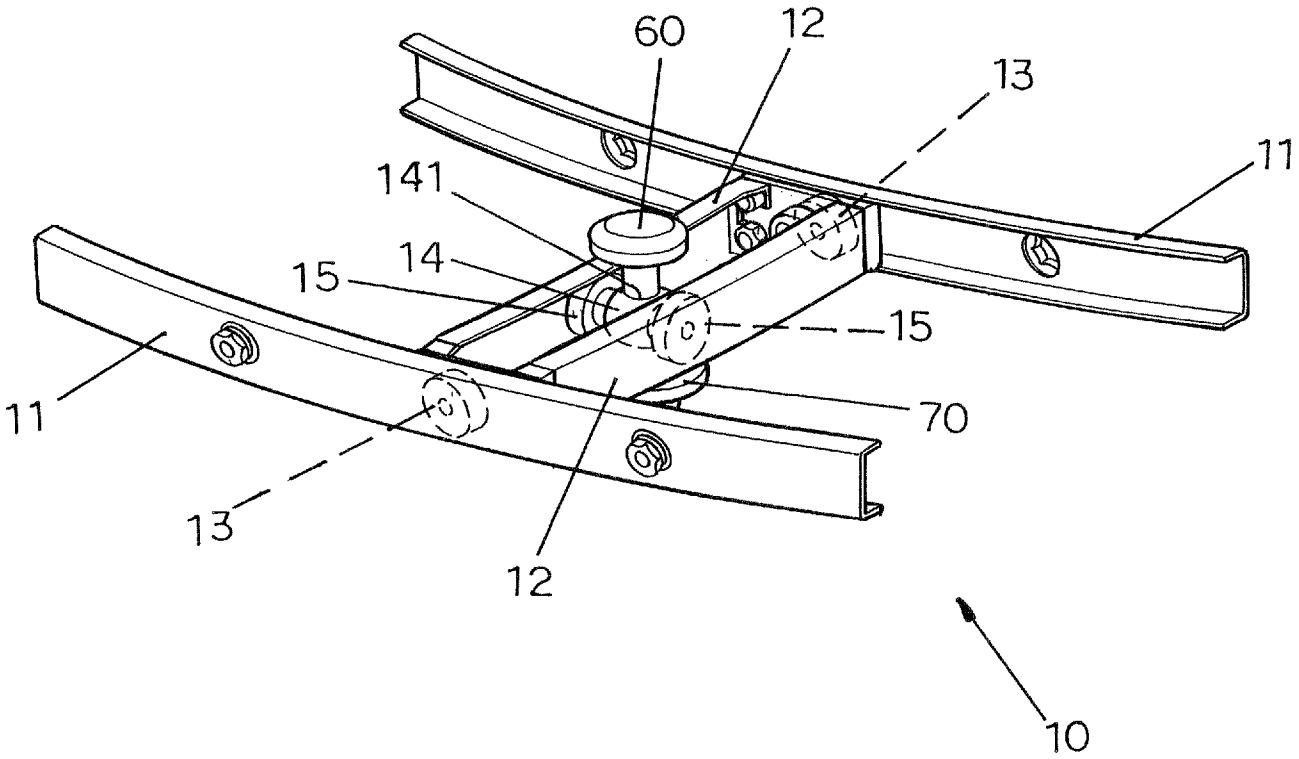
FIG. 3 is another partial assembly perspective view of the hip swinging device in accordance with the present invention.

Referring to FIGS. 1-3, a hip swinging device in accordance with the present invention comprises a rail unit 10, a fixed disk 20, a fixed frame 30, a movable disk 40 slidably disposed on the fixed disk 20, a stop unit 50 mounted below the fixed disk 20, a connecting rod 60 and a damper 70 connected to the connecting rod 60.

The rail unit 10 is provided with two straight rails 11 fixed to the fixed frame 30, two transverse rails 12, two first rollers 13 disposed at two lateral ends of the transverse rails 12 and rotatably assembled to the straight rails 11, a movable element 14 assembled between the transverse rails 12 and two second rollers 15 disposed at two lateral ends of the movable element 14 and rotatably assembled to the transverse rails 12. The movable element 14 is defined with a through hole 141 penetrating the movable element 14.

The fixed disk 20 is fixed to the fixed frame 30 and is defined with a oval or circular through hole 21 penetrating the fixed disk 20 and a plurality of stop holes 23, and a plurality of movable balls 22 are assembled to a top surface of the fixed disk 20. The fixed disk 20 is arc-shaped.

The movable disk 40 is arc-shaped and is defined with a through hole 41 penetrating the movable disk 40.

The stop unit 50 is provided with two support rails 51 fixed to a bottom surface of the fixed disk 20, two guiding pieces 52 slidably disposed in the support rails 51, a plurality of elastic stop blocks 53 fixed to top surfaces of the guiding pieces 52 and a control rod 54 connected to and provided for controlling the guiding pieces 52.

Figure 4:
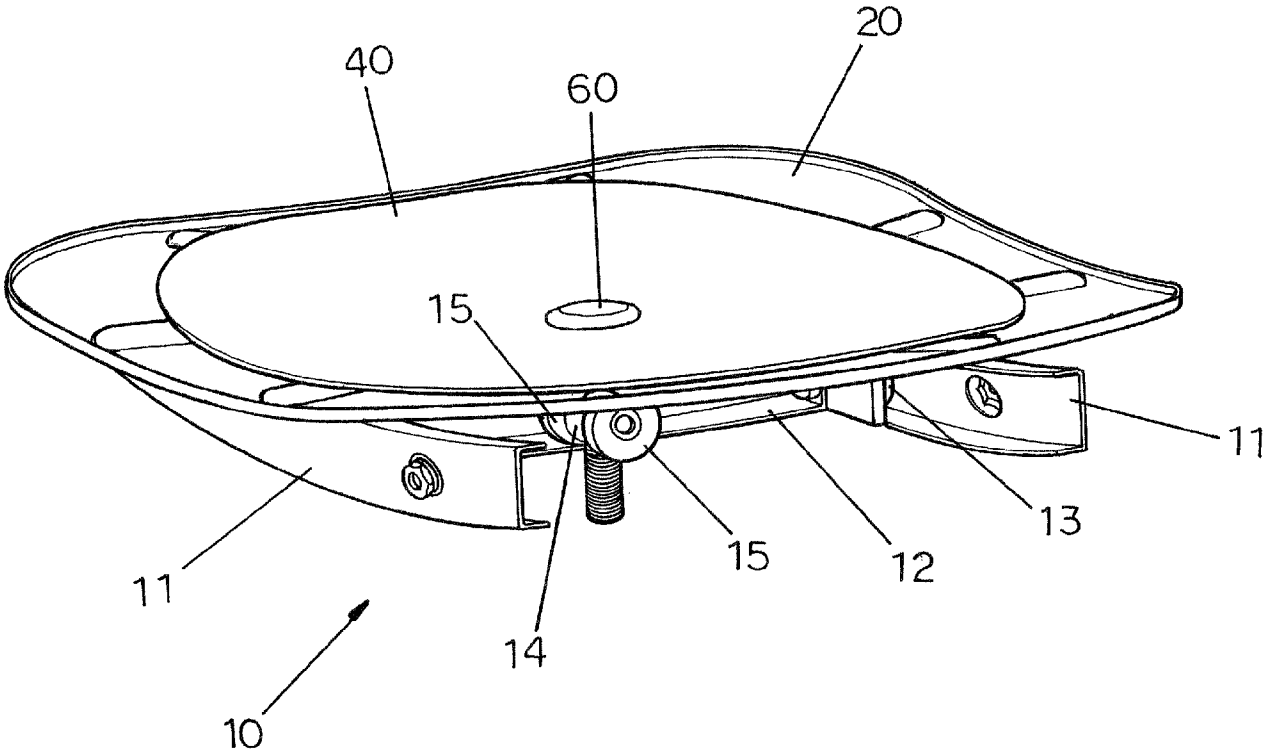
FIG. 4 is another partial assembly perspective view of the hip swinging device in accordance with the present invention.
Figure 5:
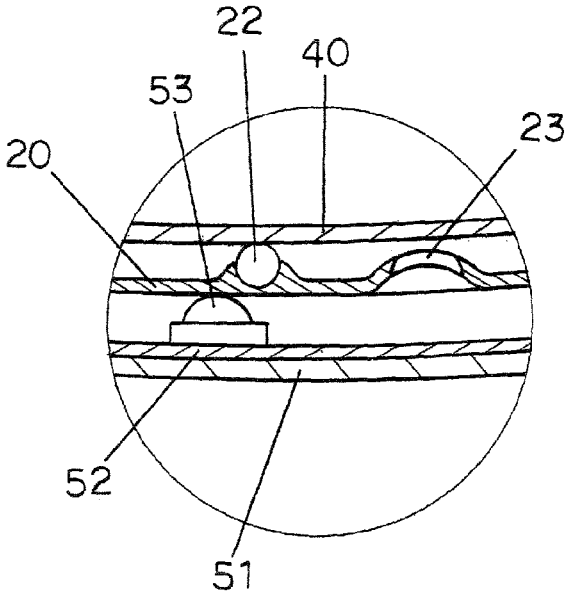
FIG. 5 is a partial assembly cross sectional view of the hip swinging device in accordance with the present invention.

When assembling, the connecting rod 60 is connected to the damper 70 by passing through the through holes 41, 21 and 141, so as to make the movable disk 40 connected to the movable element 14 (as shown in FIGS. 3 and 4), and the damper 70 will push the movable element 14 with its elasticity, which can increase the connecting stability of the movable disk 40 and the movable element 14. At that time, a bottom surface of the movable disk 40 is abutted against the balls 22, the stop blocks 53 are compressed by the fixed disk 20 (as shown in FIG. 5), and the movable element 14 is combined with the through hole 21. The damper 70 is provided with an adjustable strong spring (not shown) for adjusting the connecting force of the movable disk 40 and the movable element 14.

Figure 7:
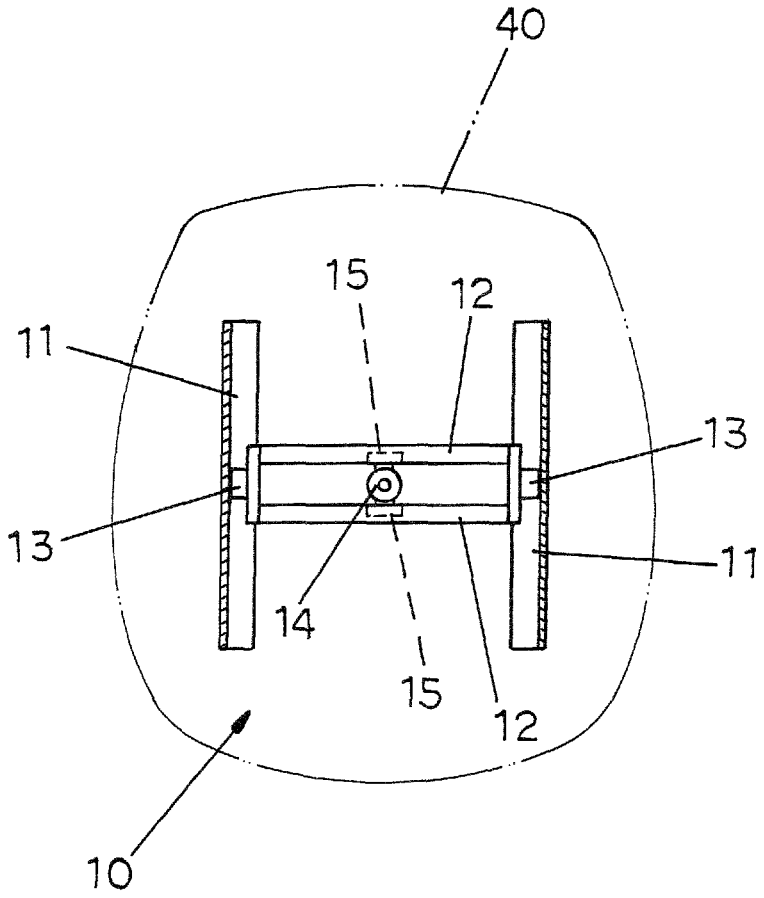
FIG. 7 is a partial assembly plane view of the hip swinging device in accordance with the present invention.
Figure 8:
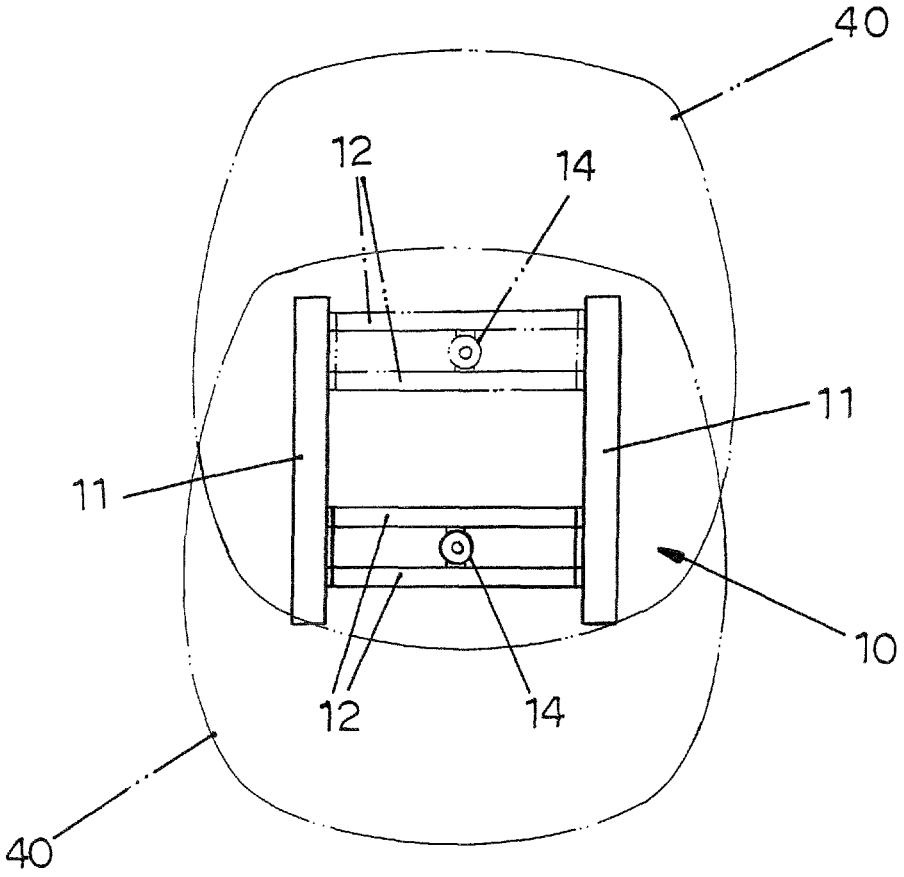
FIG. 8 is a partial plane view of the hip swinging device in accordance with the present invention.
Figure 9:
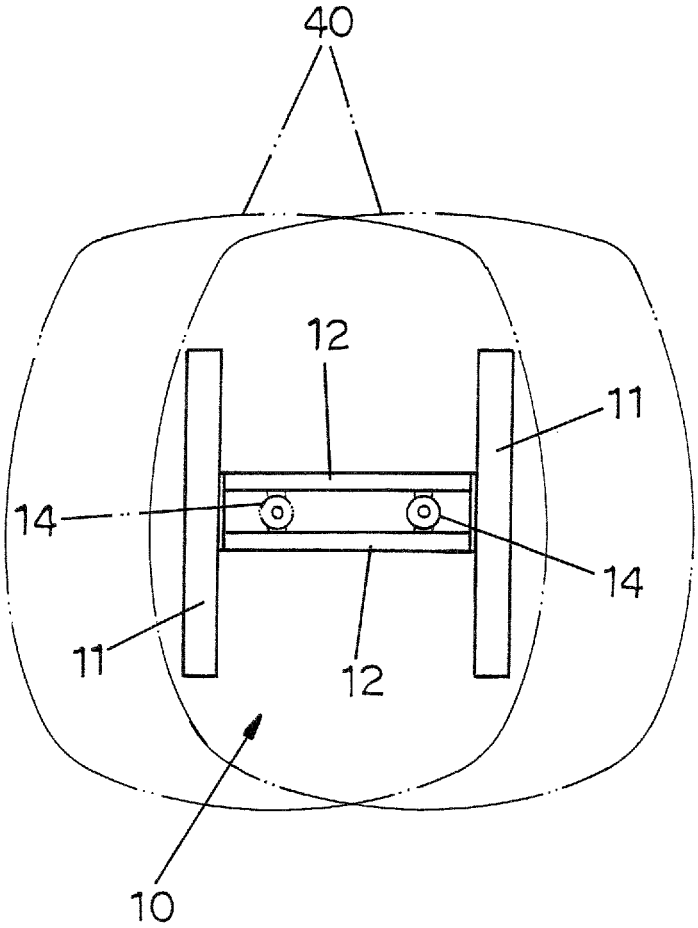
FIG. 9 is another partial plane view of the hip swinging device in accordance with the present invention.

Referring to FIGS. 7-9, when the user sits on a top surface of the movable disk 40 and twists her/his waist and hip back and forth, the movable disk 40 along with the movable element 14 will slide along the straight rails 11 to and fro via the first rollers 13. When the user twists her/his waist and hip from left to right, the movable disk 40 along with the movable element 14 will slide along the transverse rails 12 to and fro via the second rollers 15, thus achieving the object of waist and hip twisting.

Besides the back and forth and left to right sliding functions, the movable disk 40 can further perform oval or circular rotation in the through hole 21. When the connecting rod 60 moves along the edge of the through hole 21, the maximum oval or circular rotation can be achieved. When the movable disk 40 performs oval or circular rotation, the best waist and hip twisting effect can be achieved.

Figure 6:
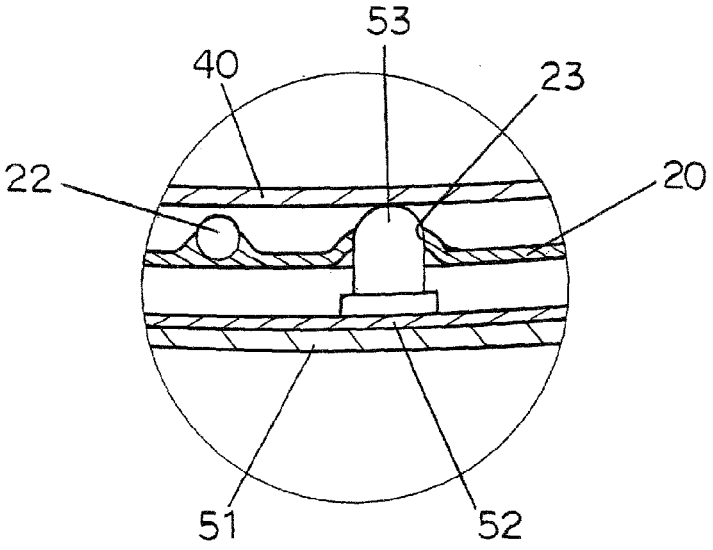
FIG. 6 is another partial assembly cross sectional view of the hip swinging device in accordance with the present invention.

When the user doesn't exercise and chooses a sitting angle, he/she can pull the control rod 54 to move the guiding pieces 52, so as to make the stop blocks 53 combined with the stop holes 23, such that the stop blocks 53 will be protruded out of the stop holes 23 and abutted against the bottom surface of the movable disk 40 (as shown in FIG. 6) by its elasticity, so as to separate the movable disk 40 from the balls 22, thus restricting the movable disk 40 for the user to sit on stably.

It is to be noted that the hip swinging device of the present invention can be assembled to an ordinary chair (such as, office chair, desk chair or chair), and the user can twist her/his hip at any time. With the rotation of the balls 22, the movable disk 40 can slide back and forth and from left to right or rotate in the through hole 21. When the user doesn't want to exercise, he/she can adjust his/her waist and hip position according to the gesture of upper part of the body for better sitting comfort.

As compared with the conventional fitness equipments, the present invention has the advantages described as follows:

Firstly, the movable disk 40 can slide back and forth with the to and fro sliding of the transverse rails 12 along the straight rails 11, the movable disk 40 can slide from left to right with the to and fro sliding of the movable element 14 along the transverse rails 12, and the movable disk 40 also can rotate. When the user sits on the movable disk 40 he/she can achieve better waist and hip twisting effect. The construct also allows the user to engage or disengage the twisting mechanism with ease.

Secondly, when the user doesn't exercise, he/she can adjust his/her waist and hip according to the gesture of upper part of the body for better sitting comfort.

While we have shown and described various embodiments in accordance with the present invention, it should be clear to those skilled in the art that further embodiments may be made without departing from the scope of the present invention.

The invention claimed is:

1. A hip swinging device comprising:

a rail unit comprising:

two straight rails, two transverse rails, two first rollers being disposed at two lateral ends of the two transverse rails and rotatably assembled to the two straight rails, a movable element being assembled between the two transverse rails and two second rollers being disposed at two lateral ends of the movable element and rotatably assembled to the two transverse rails;

a fixed disk defining with a through hole penetrating the fixed disk, a plurality of movable balls being assembled to a top surface of the fixed disk; and a movable disk connecting to the movable element via the through hole of the fixed disk, a bottom surface of the movable disk being abutted against the plurality of movable balls.

2. The hip swinging device as defined in claim 1 further comprising a fixed frame for connecting the fixed disk to the two straight rails.

3. The hip swinging device as defined in claim 1 further comprising:

a stop unit that is provided with two support rails being fixed to a bottom surface of the fixed disk, two guiding pieces being slidably disposed in the two support rails, and a plurality of elastic stop blocks being fixed to top surfaces of the two guiding pieces and compressed by the fixed disk, the fixed disk being defined with a plurality of stop holes penetrating the fixed disk, while moving the guiding pieces to align the plurality of elastic stop blocks with the plurality of stop holes, the plurality of elastic stop blocks protruding out of the plurality of stop holes and abutting against the bottom surface of the movable disk by elasticity of the plurality of elastic stop blocks, so as to separate the movable disk from the plurality of movable balls.

4. The hip swinging device as defined in claim 3, wherein the guiding pieces are connected to a control rod.

5. The hip swinging device as defined in claim 3 further comprising a connecting rod and a damper, the movable disk being defined with a through hole penetrating the movable disk, the movable element being defined with a through hole penetrating the movable element, the connecting rod being connected to the damper by passing through the through holes of the movable disk, the fixed disk and the movable element, and the damper pushing the movable element.

6. The hip swinging device as defined in claim 1, wherein the movable disk and the fixed disk are arc-shaped.

7. The hip swinging device as defined in claim 1, wherein the through hole of the fixed disk is oval or circular-shaped.

8. A hip swinging device comprising:

a rail unit comprising:

a first straight rail along a first direction;

a second straight rail generally parallel to the first straight rail;

a first transverse rail along a second direction generally perpendicular to the first direction;

a second transverse rail generally parallel to the first transverse rail;

a first roller to translate along the first direction, the first roller being disposed at a first end of the first transverse rail and a first end of the second transverse rail, the first roller being rotatably assembled to the first straight rail;

a second roller to translate along the first direction, the second roller being disposed at a second end of the first transverse rail and a second end of the second transverse rail, the second roller being rotatably assembled to the second straight rail;

a movable element being assembled between the first and second transverse rails, the movable element having a first through hole;

a third roller to translate along the second direction, the third roller being disposed at a first end of the movable element, the third roller being rotatably assembled to the first transverse rail; and a fourth roller to translate along the second direction, the fourth roller being disposed at a second end of the movable element, the fourth roller being rotatably assembled to the second transverse rail;

a fixed disk having a second through hole;

a plurality of movable balls attached to a top surface of the fixed disk;

a movable disk having a third through hole;

a damper; and a connecting rod coupling the movable disk to movable element;

wherein the connecting rod passes through the third through hole, the second through hole, and the first through hole;

wherein the damper is attached to a first end of the connecting rod;

wherein a bottom surface of the movable disk is abutted against the plurality of movable balls; and wherein the movable disk is movable along the first and second directions and is rotatable about a third direction generally perpendicular to the first and second directions.

9. The hip swinging device of claim 8, wherein the damper, the movable element, the fixed disk, the plurality of movable balls, and the movable disk are arranged in the given order in the third direction.

10. The hip swinging device of claim 8 further comprising a fixed frame for connecting the fixed disk to the first and second straight rails.

11. The hip swinging device of claim 8 further comprising:

a stop unit having two or more support rails being fixed to a bottom surface of the fixed disk;

two or more guiding pieces being slidably disposed in the two or more support rails; and a plurality of elastic stop blocks being fixed to top surfaces of the two or more guiding pieces;

wherein the fixed disk further has a plurality of stop holes; and wherein the plurality of elastic stop blocks are characterized by:

a compressed condition in which the plurality of elastic stop blocks are compressed by the fixed disk; and a protruded condition in which the plurality of elastic stop blocks are aligned with the plurality of stop holes, the plurality of elastic stop blocks protrude out of the plurality of stop holes, and the plurality of elastic stop blocks abut against the bottom surface of the movable disk by elasticity of the plurality of elastic stop blocks so that the movable disk is separated from the plurality of movable balls.

* * * * *